US005344606A

United States Patent [19]

Brimmer

[11] Patent Number: 5,344,606

[45] Date of Patent: Sep. 6, 1994

[54] FLUID TREATMENT ALLOY CASTING OF CU-SN-NI-ZN

[76] Inventor: Thomas E. Brimmer, 15259 Debbie Cove, Gulfport, Miss. 39503

[21] Appl. No.: 59,805

[22] Filed: May 7, 1993

[51] Int. Cl.[5] ..... C22C 9/00

[52] U.S. Cl. ..... 420/473; 148/434; 420/470; 420/477; 420/479

[58] Field of Search ..... 420/473, 477, 479, 470; 148/434

[56] References Cited

U.S. PATENT DOCUMENTS

| | | | |
|---|---|---|---|
| 3,891,394 | 6/1975 | Smith et al. | 420/473 |
| 4,429,665 | 2/1984 | Brown | 123/3 |
| 4,632,806 | 12/1986 | Morikawa et al. | 420/473 |
| 4,644,674 | 2/1987 | Burrows et al. | 420/473 |
| 5,059,217 | 10/1991 | Arroyo et al. | 123/1 A |
| 5,124,122 | 6/1992 | Wojcik | 420/421 |

OTHER PUBLICATIONS

Understanding Copper Alloys, ed. Mendelhall, Olin Brass, 1977, pp. 3–5.

*Primary Examiner*—Upendra Roy
*Attorney, Agent, or Firm*—Alexander F. Norcross

[57] ABSTRACT

A suitable casting alloy for use in a fluid treatment device may be made as a copper-nickel-zinc-tin (CU—NI—ZN—SN) alloy without the addition of silver, silicon or magnesium, if certain identified trace metals are kept below certain levels. It appears that the previously identified additive metals, which are either expensive or dangerous, act to counteract the deleterious effects of these trace contaminants, and are not necessary of the contaminants are controlled. A method of forming the alloy prevents the explosive reactions encountered when melting together metals having significantly differing vaporization and melting temperatures.

3 Claims, No Drawings

FLUID TREATMENT ALLOY CASTING OF CU-SN-NI-ZN

BACKGROUND OF THE INVENTION

This Invention pertains to the field of casting alloys, specifically alloys of Copper containing elements for catalytic enhancement of hydrocarbon fuel burning.

U.S. Pat. No. 4,429,665 to Brown discloses a device for improving the combustion efficiency of liquid fuels, which contains an internal casting of a disclosed alloy composition which reportedly has catalytic properties on hydrocarbon fuels. The disclosed alloy is a mixture of nickel, zinc, copper, tin and silver. The alloy is formed by melting together copper, tin and silver at a temperature of 1800°-2100° F., then raising the mixture to 2600-2800 degrees F. and adding nickel and then raising the mixture to 3200-3400 degrees F. and adding zinc. Since zinc has a vaporization point of less than 1665 degrees F. and is explosive as a powder, the resulting reaction is violent.

U.S. Pat. No. 5,059,217 to Arroyo et al discloses a fuel treating device using an internal cast metal bar of an alloy comprising 40-50% copper, 15-30% nickel, 10-20% zinc, 5-20% tin, 1-15% Magnesium, and 0.5-5% Silicon. Magnesium is a known flammable metal of very dangerous properties, and the resulting alloy is dangerous to produce.

In both patents, the resulting alloy comprises metals having significantly differing melting and boiling points, so that the lighter metals would boil off if dissolved first and the mixture then were raised to the minimum temperature necessary to melt Nickel; on the other hand, creating a solution of molten nickel first produces a solution at a temperature above the vaporization point of zinc, which is a highly reactive metal. The alloys are therefore difficult and dangerous to form.

Further, in order to achieve the desired percentages of metal, purified metal stock is specified to make the above alloys. Since the end item produced, a motor fuel treatment device, is intended to be produced in large quantities, this results in the possible consumption of large quantities of purified virgin metal stock.

SUMMARY OF THE INVENTION

I have discovered that a suitable casting alloy for use in the fluid enhancement devices of the prior art may be made as a copper-nickel-zinc-tin (CU—NI—ZN—SN) alloy without the addition of silver, silicon or magnesium, if certain identified trace metals are kept below certain levels. It appears that the previously identified additive metals, which are either expensive or dangerous, act to counteract the deleterious effects of these trace contaminants, and are not necessary of the contaminants are controlled.

I have further discovered a method of producing such alloys which overcomes the dangers inherent in the identified prior art method of forming the liquid alloy solution, and which has the additional advantage of utilizing scrap materials, enhancing recycling efforts.

I have further discovered that the alloy of my invention has beneficial water treatment properties. Water filters and treatment devices made of the alloy disclosed reduce bacteria count and microorganism growth in fresh water, such as in swimming pools, air conditioner heat exchangers and the like. This in turn reduces the need for chlorine treatment, and prevents fouling of fresh water circulation tanks, piping and plumbing. Further this effect avoids the introduction of chemicals into the water, rendering the water non-toxic and safe. Filters of the alloy disclosed may therefore be used in animal watering systems such as at kennels and in agricultural services.

It is therefore an object of the invention to disclose an alloy for use in a fluid enhancement device which is easier and less expensive to produce.

It is a further object of the invention to disclose an optimized CU—NI—ZN—SN alloy for use in a fluid enhancement device.

It is a further object of the invention to disclose an improved CU—NI—ZN—SN alloy for casting.

It is a further object of the invention to disclose an improved method of making a CU—NI—ZN—SN alloy for casting.

It is a further object of the invention to disclose a method of making a CU—NI—ZN—SN alloy for casting which enhances the use of recycled scrap metals.

These and other objects of the invention may be more clearly seen from the detailed description of the invention which follows.

DETAILED DESCRIPTION OF THE INVENTION

I have discovered that metal inserts, as described for the prior art fuel enhancement devices, are very dangerous to make due to the admixture of metals having widely differing melting and vaporization temperatures. In particular the specified zinc and magnesium components produce violent reactions if dissolved in a nickel solution, which must be at a temperature will above the flash points of either metal.

In study of this question I have discovered that certain specified trace metals in the prior art alloys are not necessary if certain contaminants are controlled in the alloy, producing a simplified alloy. In particular I have discovered that the presence of Manganese, Aluminum or iron in the resulting alloy inhibits the catalytic effect, and that the previously used silver, magnesium, and silicon apparently were required to counteract the inhibitory effect of these specific contaminants.

Specifically I have discovered that if the amount of Manganese is held below 1.0 percent by weight and the total Aluminum is held below 0.05 percent (five one hundredths percent) and the total iron is held below 0.5 percent (one half percent), all by weight) that the mixture performs optimally solely as a CU—NI—ZN—SN alloy having the following proportions:

| |
|---|
| Copper from 52% to 55% |
| Tin from 5% to 6% |
| Nickel from 16% to 18% |
| Zinc from 22% to 25% |

each percentage being by weight, and the percentage of each element for any specific alloy being adjusted to be within the range cited while the total percentage for all four elements totals 100%.

A particularly optimum alloy is

| | |
|---|---|
| copper | 54.5% |
| tin | 5.35% |
| zinc | 22.1% |

-continued

| | |
|---|---|
| Nickel | 17.1%, all percentages rounded the nearest 0.1% |

and trace contaminants held equal to or below:

| | |
|---|---|
| lead | <0.53% |
| Iron | <0.42% |
| Aluminum | <0.008% |
| Manganese | <0.022% |
| Silicon | <0.008% |

This alloy is best prepared by a technique which I have discovered which largely eliminates the hazards of the prior art mixing, while permitting the use of scrap and salvaged materials. I have discovered that commonly available plumbing bronzes include a nickel bronze comprised of a Copper-Nickel alloy and standard pipe bronze comprised of a Copper Zinc alloy. Due to the service for which such special bronzes may be employed, the resulting materials, while widely commercially available, have extremely low levels of the contaminant metals I have above identified as deleterious for the fuel treatment alloy.

Typical Nickel bronzes are 70% copper and 30% nickel by weight. Typical Pipe bronzes are 70% copper and 30% zinc by weight. Suitable other bronzes are identified in the publication "Casting Copper Based Alloys" published by the American foundryman's Society, Des Plaines, Ill.

The desired alloy may be obtained by melting scrap nickel bronze; this material has a lower melting point than does pure Nickel, and typically can be held in solution at 2100 degrees F. Then a suitable quantity of pipe bronze scrap is dissolved in the Nickel bronze solution to obtain the desired zinc content. Since the Zinc is pre dissolved in copper in the pipe bronze, the violent reaction occasioned by introducing pure zinc to such a mixture is avoided, and zinc vaporization seems to be minimized. Tin is then dissolved in the resulting solution either by adding elemental tin or by adding tin-bronze scrap. A Trace amount (1 to 2 ounces per 100 pounds of alloy) of Phosphorous, in the form of phosphorous bronze, or of silver is then added to degas the resulting melt, and the desired articles are cast from the liquid molten alloy.

This process takes maximum advantage of recycled scrap, reducing the costs and environmental burden of producing the alloy. It further reduces the significant safety risks in producing the alloy according to the prior art teachings. The resulting alloy is particularly advantageous in the fuel enhancement devices of the prior art, but also the method and alloy are particularly suitable for any use in which a combined nickel zinc bronze is required and desired.

For example of other fluid treatment uses, I have discovered that the alloy of the invention is useful as a water treatment or filter element. It appears to inhibit microorganism growth in fresh water while not adding any chemical additives to the water. In swimming pool use, the alloy permits significant reduction in the amount of chlorine needed to maintain water purity. Further, water treatment units using the alloy can prevent or reduce sludge and bacterial buildup in air conditioning heat exchangers and in water feed systems for agricultural use, such as unattended livestock watering wells, or in kennels and the like. I therefore refer to the alloy as a fluid treatment alloy, as its uses apparently extend beyond the fuel treatment pointed out in the cited prior art. The resulting alloy is substantially free of the contaminant metals.

I claim:

1. A fluid treatment alloy for casting consisting of:
copper in the amount of 52 to 55% by weight;
tin in the amount of 5 to 6% by weight;
Nickel in the amount of 16 to 18% by weight; and
Zinc in the amount of at least 20%; and
no silver, silicon or magnesium.

2. A fluid treatment alloy for use as a catalytic surface in a fluid treatment apparatus, comprising
copper in the amount of 52 to 55% by weight;
tin in the amount of 5 to 6% by weight;
Nickel in the amount of 16 to 18% by weight; and
Zinc in the amount of at least 20%;
said alloy containing less than 1% manganese, less than 0.05% aluminum, and less than 0.5% iron, and no added silver, silicon or magnesium.

3. the alloy of claim 2 comprising:
copper in the amount of 54.5%±0.1% by weight;
tin in the amount of 5.4%±0.1% by weight;
Nickel in the amount of 17.1%±0.1% by weight; and
Zinc in the amount of at least 22.1±0.1% %;

* * * * *